US007747189B2

(12) United States Patent
Shanun et al.

(10) Patent No.: US 7,747,189 B2
(45) Date of Patent: Jun. 29, 2010

(54) PROCESS AND APPARATUS FOR INSTALLING ORIGINAL DRIVE GEAR ON A LASER PRINTER TONER CARTRIDGE DRUM

(75) Inventors: Sagie Shanun, Sherman Oaks, CA (US); Joda Paulus, Chatsworth, CA (US)

(73) Assignee: Wazana Brothers International, Van Nuys, CA (US)

( * ) Notice: Subject to any disclaimer, the term of this patent is extended or adjusted under 35 U.S.C. 154(b) by 404 days.

(21) Appl. No.: 11/959,994

(22) Filed: Dec. 19, 2007

(65) Prior Publication Data

US 2009/0162093 A1 Jun. 25, 2009

(51) Int. Cl.
*G03G 15/00* (2006.01)

(52) U.S. Cl. ..... 399/109

(58) Field of Classification Search ..... 399/109, 399/110, 111, 112, 113, 114, 115, 116, 117, 399/118, 119, 120, 159, 167; 451/28, 47; 29/90.01, 90.6

See application file for complete search history.

(56) References Cited

U.S. PATENT DOCUMENTS 5,402,207 A 3/1995 Michlin
5,739,900 A * 4/1998 Isobe ..... 355/109
5,781,830 A * 7/1998 Gaylord et al. ..... 399/109
5,845,173 A 12/1998 Zogg et al.
5,870,654 A * 2/1999 Sato et al. ..... 399/109
6,157,038 A 12/2000 Swain et al.
6,223,010 B1 * 4/2001 Araki ..... 399/109
6,615,006 B2 * 9/2003 Michlin et al. ..... 399/90
6,898,399 B2 * 5/2005 Morioka et al. ..... 399/167
7,272,330 B2 * 9/2007 Harlan et al. ..... 399/26
7,630,678 B2 * 12/2009 Kishi et al. ..... 399/350
2002/0028087 A1 * 3/2002 Higeta et al. ..... 399/109
2002/0172528 A1 * 11/2002 Sekine ..... 399/109
2003/0021613 A1 * 1/2003 Koide ..... 399/167
2004/0037590 A1 * 2/2004 Morioka et al. ..... 399/167
2007/0196130 A1 * 8/2007 Okabe et al. ..... 399/167
2008/0008495 A1 * 1/2008 Martin et al. ..... 399/109

FOREIGN PATENT DOCUMENTS

EP 0528568 A 2/1993
JP 09187820 A 7/1997

* cited by examiner

*Primary Examiner*—David P Porta
*Assistant Examiner*—Kiho Kim

(57) ABSTRACT

In the field of laser printer toner cartridges, systems and methods for removing a drive gear from an original, spent photosensitive drum or member, preparing and re-installing the drive gear on a new drum surface roughening, cleaning, contact straightening and priming of the original gear; cleaning and laser etching the new drum; gear positioning and adhering the gear to the drum with an epoxy/amine adhesive, electrical continuity testing and curing of the gear-drum assembly.

19 Claims, 12 Drawing Sheets

PRIOR ART

PROCESS AND APPARATUS FOR INSTALLING ORIGINAL DRIVE GEAR ON A LASER PRINTER TONER CARTRIDGE DRUM

FIELD OF INVENTION

The invention relates generally to the field of laser printer toner cartridges and more specifically to the field of remanufacturing such cartridges.

BACKGROUND

A laser toner cartridge contains a few significant components that directly affect the print quality and durability over time. These significant components are all located in the development section of the cartridge. The above mentioned components are the photosensitive drum that is made of an electrically conducting material such as aluminum, the developing roller, the regulating member and the primary charge roller.

During operation of a laser printer the photosensitive drum rotates as its drive gear is rotated. Specific models of cartridges are known to have specific gear designs. Also, such gears are typically attached to the drum by mechanical techniques, such as described in U.S. Pat. No. 7,248,841, where a mechanical crimping and coupling process was used.

The coating on the photosensitive drum typically wears off after one lifecycle of the cartridge as a result of constant friction between the photosensitive component and the primary charge roller, as well as friction between the developing roller and the printed media. The amount of wear depends on multiple factors such as: type of media printed, average coverage area of the printed documents, type of toner used, type of documents printed (short: 1-2 pages or long: 100+pages) type of coating etc. It was found out that more often than not using the same photosensitive drum for another or second lifecycle, would not produce the same print quality as the original cartridge over the whole second lifecycle of the remanufactured cartridge. Therefore, in conventional remanufacturing processes the photosensitive drum is treated as an exhausted component and is replaced by a new one on all known remanufactured models of cartridges.

While the photosensitive drum can become exhausted during a single lifecycle, the drum's drive gear typically does not become exhausted with such use, and can be re-used. In addition, the original drum's drive gear, or specific features of a drum's drive gear may be the subject of one or more patents, such as for example the particular shape of a drive gear that is unique to a certain product line. In order to reuse a cartridge component conventionally considered to be not reusable, as a precaution in order to avoid possible patent infringement claims and as a way to reduce costs of remanufacturing a toner cartridge, a need exists for a process and associated apparatus by which the drive gear of original equipment toner cartridge photosensitive drums may be reused.

SUMMARY

Responding to the aforementioned need, described herein are apparatuses and processes for reuse of an original photosensitive drum drive gear of a laser printer toner cartridge. The process includes removal of the original gear from the original photosensitive drum and installation of the original gear onto a new drum cylinder. The original gear is installed by coupling the prior art gear to the new drum preferably by surface treating the original gear to render it more capable of holding an adhesive, and then using adhesive to couple the original gear to a new drum. Preferably the original drive gear from the original photosensitive drum (also referred to as a "member") has been used at least one lifecycle, and is then installed on the new photo sensitive member.

Because the design concepts of the original drive gear and the adherence to the original photosensitive drum are essentially different from those of a replacement gear and drum, the original gear is modified to improve its adhesion capability and the thus modified original gear is installed in the drum by an adhesive processes in order to assure durability and consistency of the product over the cartridge's lifecycle. The preferred process for reusing a photosensitive drum drive gear includes removing the original gear from the original photosensitive drum by using a pneumatically operated machine that clamps the drive gear in a fixed position, and then is removed from the drum by twisting the photosensitive cylinder out of position and off of the gear manually. The gear removal optionally can be done automatically as well manually, or by using an electrical clamp or a hydraulic clamp.

The original drive gear is then selectively roughened using blasting media, manual sanding, knurling and/or creating channel grooves on the surfaces of the gear that contacts the drum. Then the part is thoroughly cleaned using an ultrasonic bath or manually cleaned using cleaning solvents such as iso-propanol, MEK (methyl-ethyl ketone), acetone or mild detergents. The electrical contacts of the original gear are straightened out in order to assure electrical continuity once the gear is pushed into a new drum. The inside of the new drum is degreased using a solvent such as iso-propanol, and dried. One area or more close to the end on the internal side of the new drum is preferably laser etched, or otherwise roughened in a patch form in order to remove the anodized layer of aluminum on the drum and thus to provide a path for electrical continuity between the contacts on the drive gear and the drum. The roughened surface of the drive gear is preferably primed using a diluted adhesive in order to achieve high surface contact between the inner surface of the photosensitive drum and the outer periphery of the drive gear shaft.

Adhesive is then applied on the internal surface of the photosensitive drum preferably using an automatic adhesive dispenser or dispensing the adhesive manually. The adhesive is preferably dispensed while rotating the drum. The whole adhesive application apparatus is preferably positioned at an angle in order to allow visual inspection of the quality of the application and the consistency of the dispensed adhesive. The drive gear is preferably aligned on a rotary bearing in order to facilitate aiming at or placing the contact on the area of the inside of the drum intended to provide the path for electrical continuity, such as for example a laser etched patch on the inside of the drum near the end where the gear is installed. Then the drive gear is pushed into the drum preferably using a pneumatic piston in order to prevent possible contamination of the coating that might result during a manual insertion. The electrical continuity between the cylinder or drum and the shaft of the drive gear is then tested. At this stage of the process, new drums having the original drive gears installed are then preferably stacked vertically and left to cure, preferably for not less than 12 hours at room temperature, for example at a temperature in the range of about 60-75 degrees F, with the drive gears facing down. This orientation is preferred in order to assure good flow of the adhesive towards a tapered area of the gear, where it is believed that the strongest areas of bonding results.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols or names are used in the figures to indicate certain components, aspects or features shown therein. Reference symbols common to more than one Figure indicate like components, aspects or features shown therein.

DESCRIPTION OF PREFERRED EMBODIMENTS

Hereinafter, preferred embodiments of the present invention will be described with reference to FIGS. 1-12 of the drawings and with reference to Tables 1-3.

Figure 1:
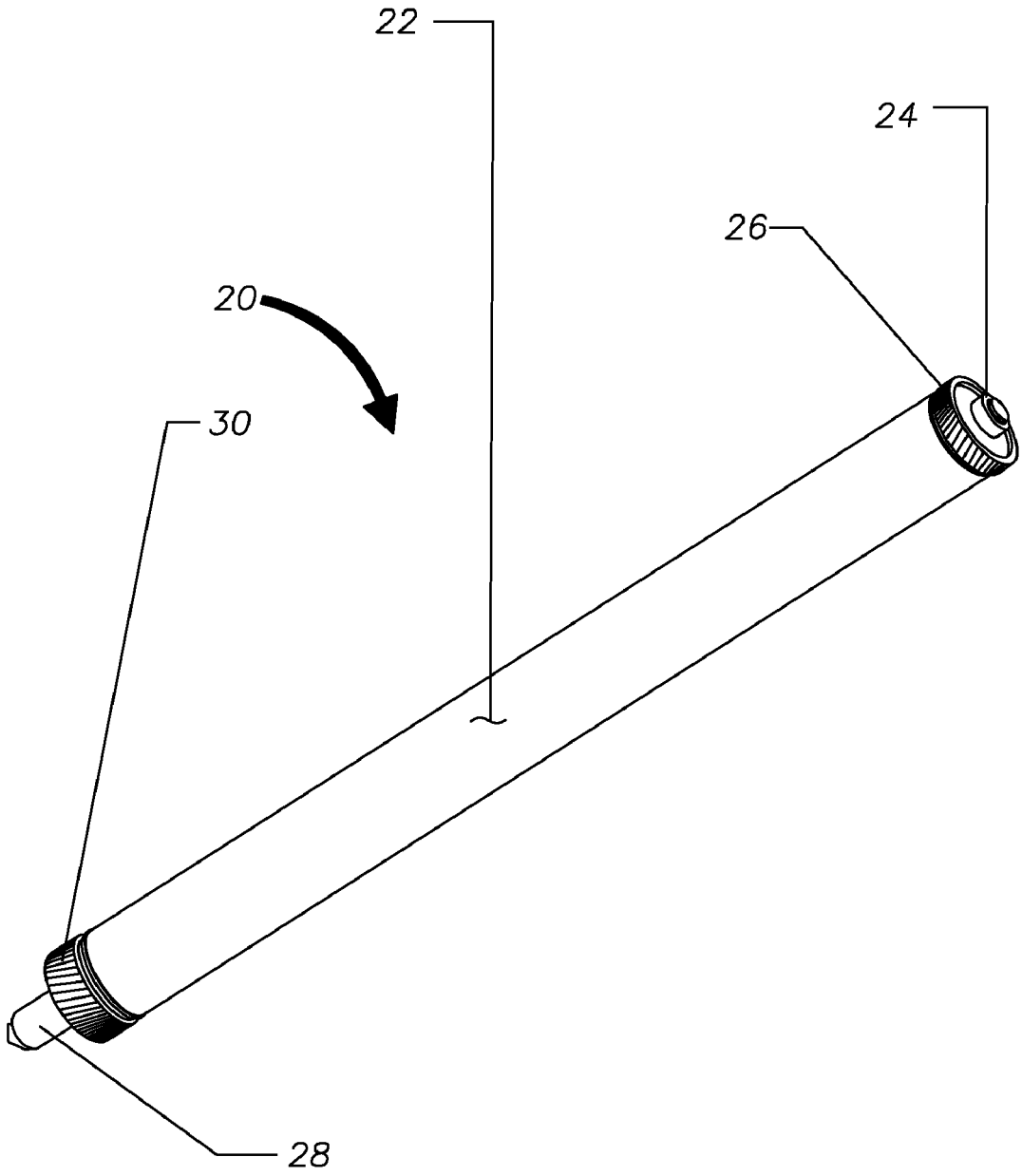
FIG. 1 is a perspective view of a new photosensitive member assembly with the original drum drive gear and a new axle gear or drive gear installed.

Referring to FIG. 1, a photosensitive member final assembly 20 is comprised of preferably, a new aluminum cylinder 22 whose surface has been treated with anodizing and a photosensitive coating on top, that is on its outer surface, and may also be referred to as a drum-cylinder. A small, new, helical gear assembly 24 with helical teeth 26 has been installed on the new drum-cylinder 22. Also an original helical drive gear assembly 28 with helical teeth 30 has been removed from a depleted original drum and has been installed on the new drum-cylinder 22 in accordance with the principles of the present inventions.

Figure 2:
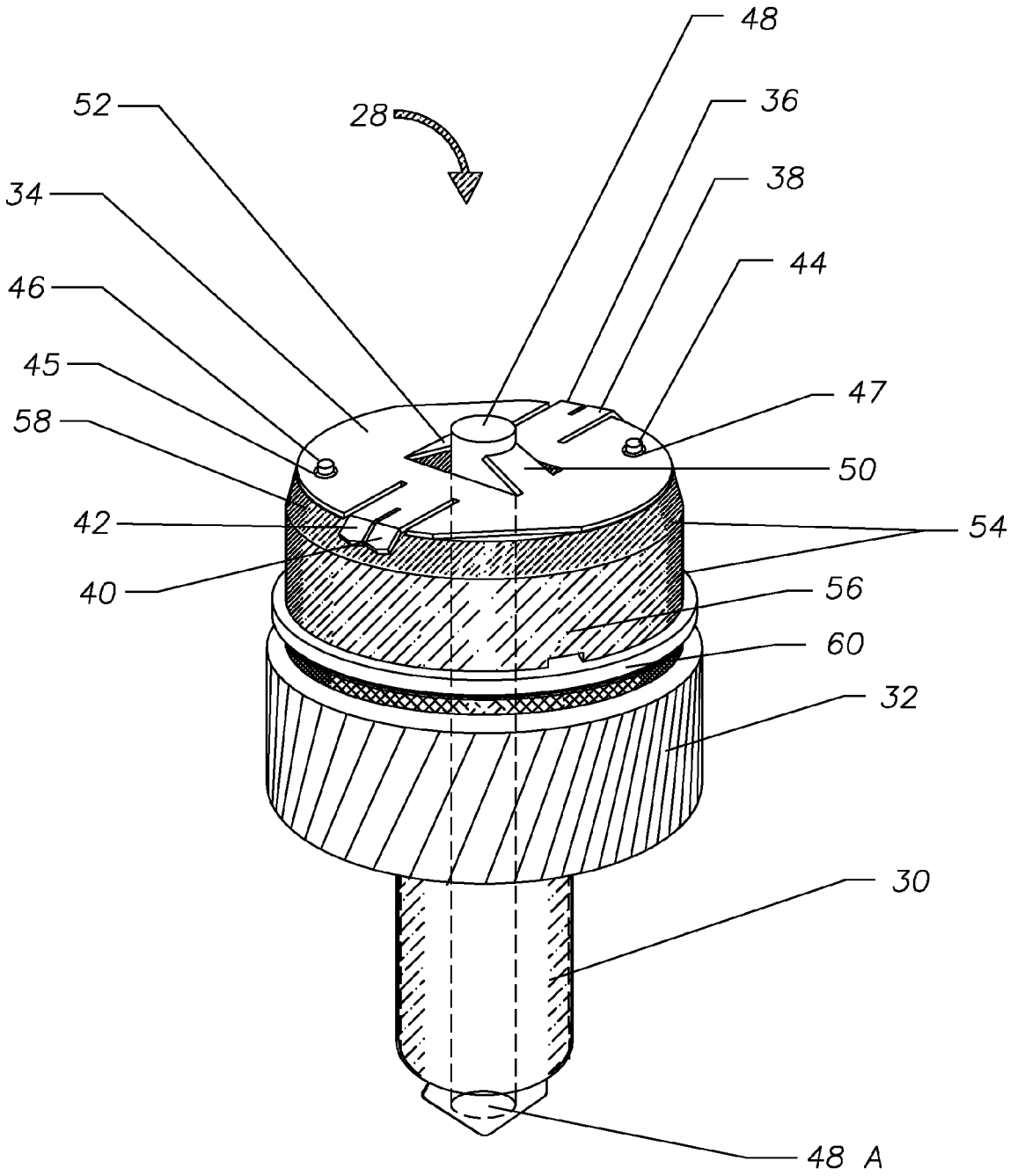
FIG. 2 is a perspective view of a prior art drum and drive gear assembly.

Referring to FIG. 2, a conventional drive gear assembly 28 includes a molded helical gear 30 and helical teeth 32 as well as a metal grounding contact plate 34 in the form of a disc. The grounding plate 34 has two opposing pairs of parallel tabs with predetermined lengths as shown at 36, 38, 40 and 42. The parallel tabs are cut from the periphery of the grounding plate. The tabs 36, 38, 40 and 42 have an end portion that is slightly bent towards the driven side of the gear. The purpose of the tabs 36, 38, 40 and 42 is to create a conductive path for electrical continuity between the drum cylinder 22 (FIG. 1) and the drum ground contact member 48. Grounding plate 34 is positioned towards the helical molded gear 30 using two holes 44, 46 that are force-fitted on dowel plastic pins 45, 47 on the gear 30. The ground contact member 48 provides a path to ground for the drum assembly 20 (FIG. 1) through a contact on the toner cartridge that is in turn grounded to the printing apparatus (not shown in the drawings). The grounding member 48 is pressure fitted into the grounding plate 34 and electrically connected to the plate 34 using two leaf spring contacts 50, 52.

Figure 4:
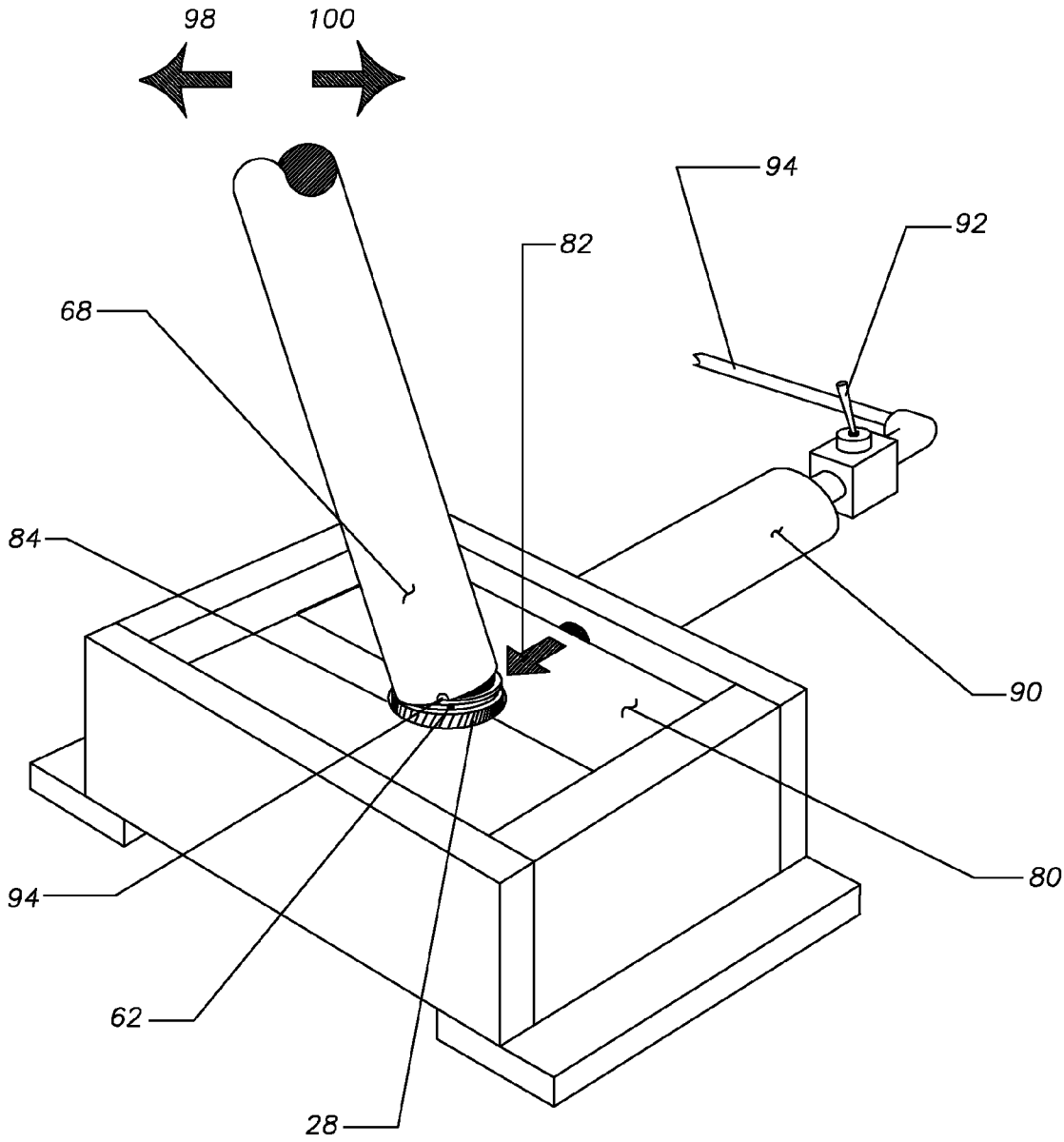
FIG. 4 is a perspective view of the FIG. 3 apparatus and with its sliding grip in the "close" position.
Figure 7:
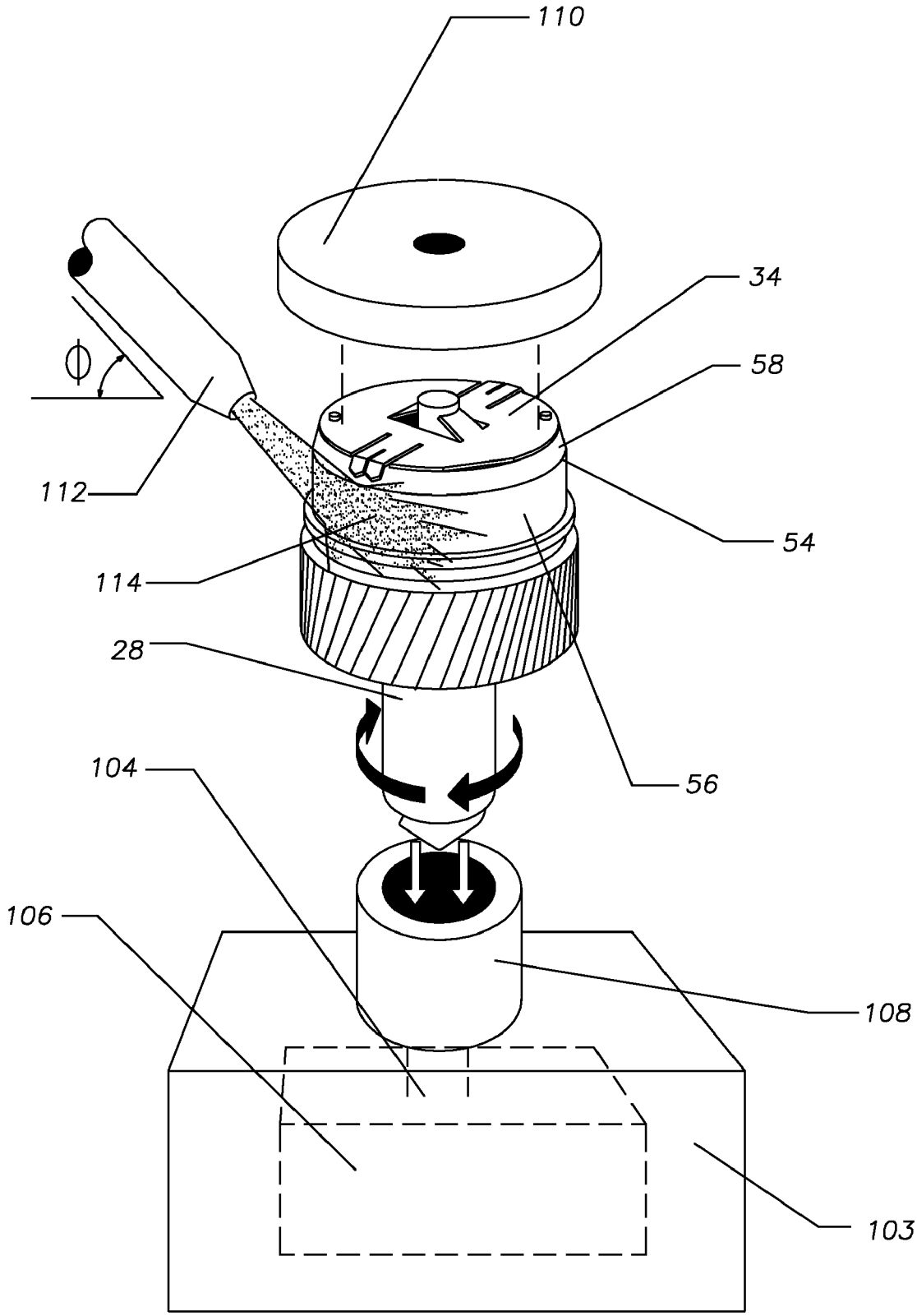
FIG. 7 is a perspective view of media blasting the original drum drive gear's adhesion surface in order to roughen the surface prior to adhesion.

Adhesion surfaces 54, 54, shown on the surfaces of a prior art gear in FIG. 2, and in a prior art gear as it is being surface treated with sand blasting, as shown for example in FIG. 7, are the surfaces used further on in the process to adhere the original drive gear assembly 28 to the new drum cylinder 22 as shown in FIG. 1. The surfaces 54 include the gear flange 56 and a tapered area 58, both of which are highlighted in the FIG. 2 drawing by dashed lines. The tapered area functions were designed in order to guide travel of the gear into the drum cylinder once it is initially inserted into the drum cylinder. In the original drum assembly there is no adhesive involved and the drum cylinder is crimped to the gear using two pre-cut tabs on the drum shown at 94 in FIG. 4. The tabs are bent or fit into two slots on the gear 62, one as shown in FIG. 4, and the other slot located on the opposite side and not shown. A limiting rail 60 (FIG. 2) is a location guide to the drive gear 28 location on the drum cylinder 22, as shown in FIG. 1.

Figure 3:
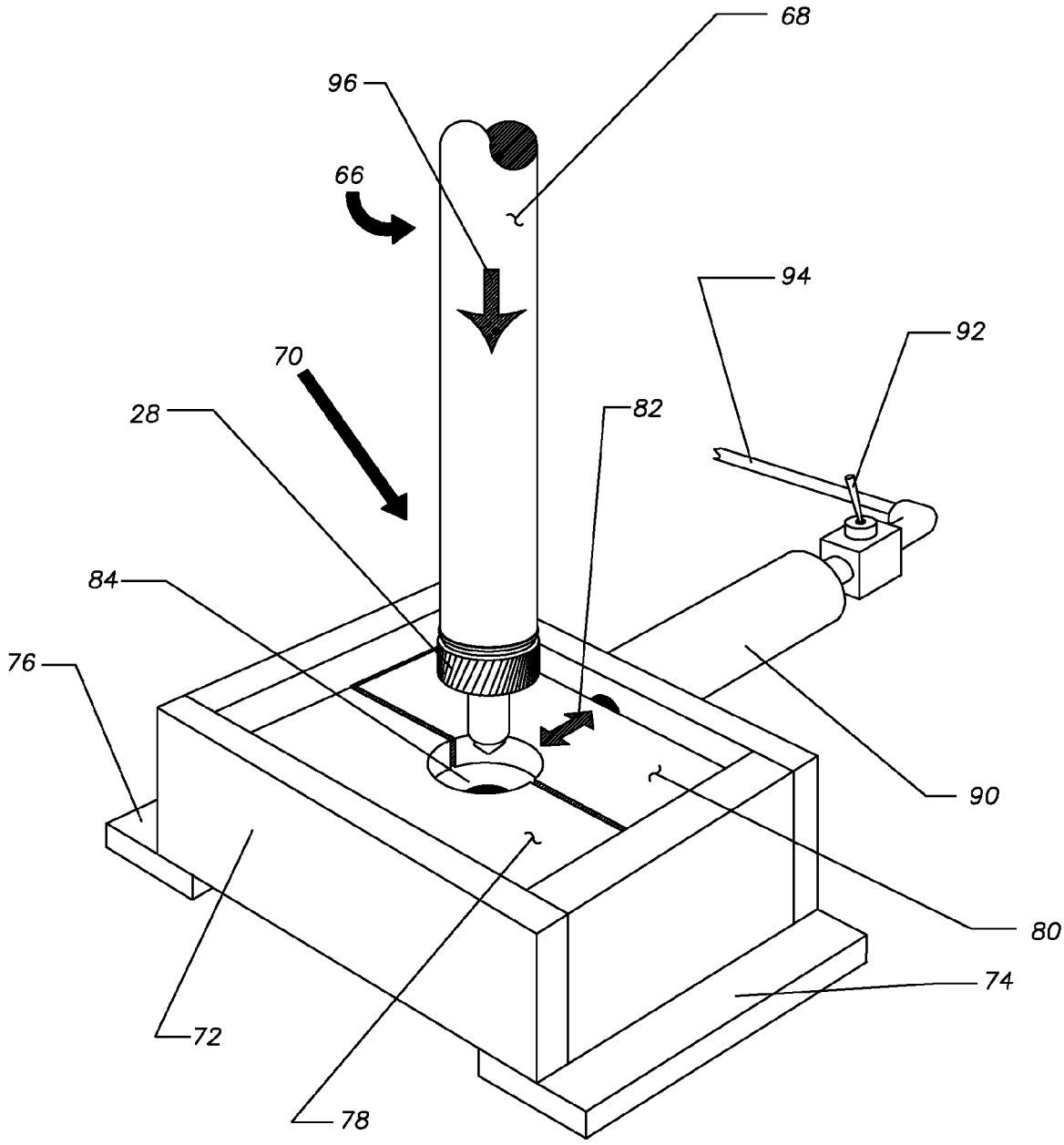
FIG. 3 is a perspective view of a preferred apparatus for removing the original drum drive gear from the original drum cylinder and with its sliding grip in the "open" position.

Referring to FIG. 3 a process for removing the original drum drive gear 28 from the original drum cylinder 68 using a pneumatic clamp will be described. Pneumatic clamp apparatus 70 is comprised of clamp housing positioning legs 74, 76; a base or housing, one wall of which is shown at 72; a stationary grip 78; and a sliding grip 80. The sliding grip 80 slides back and forth in the directions of the arrow 82 and has two positions "open" and "close". Once the sliding grip 80 is in the open position the gear is inserted into sleeve 84 in order to hold it in position. Pneumatic air cylinder 90 drives the sliding grip 80 in the directions of the arrow 82 to open and close the clamp. The apparatus 70 also includes an air switch 92 that has two positions "open" and "close", and a compressed air delivery hose 94. In order to operate the apparatus to insert a cylinder, the switch 92 has to be on "open" mode. The drum is then vertically inserted into the sleeve 84 in the direction of arrow 96.

Referring to FIG. 4, is a continuation of the removal process of the prior art drive gear 28 from the original drum cylinder 68 by using a pneumatic clamp apparatus 70 will be described. Once the drive gear 28 is in the sleeve 84 the switch 92 is then actuated or pushed to the "close" position (not shown) and the sliding grip 80 clamps the gear 28 in a fixed position, with the grip 80 shown to be closed in FIG. 4 and compared to its open position as shown in FIG. 3. Then the original drum cylinder 68 is rocked back and forth in the directions of the arrows 98, 100 in order to break the connection between the crimping tab 94 and the slot 62 thus releasing drum cylinder 68 from gear 28. The prior art drum cylinder 68 may then be recycled or discarded, in another manner and the gear then can be forward to be used in a new drum.

Figure 5:
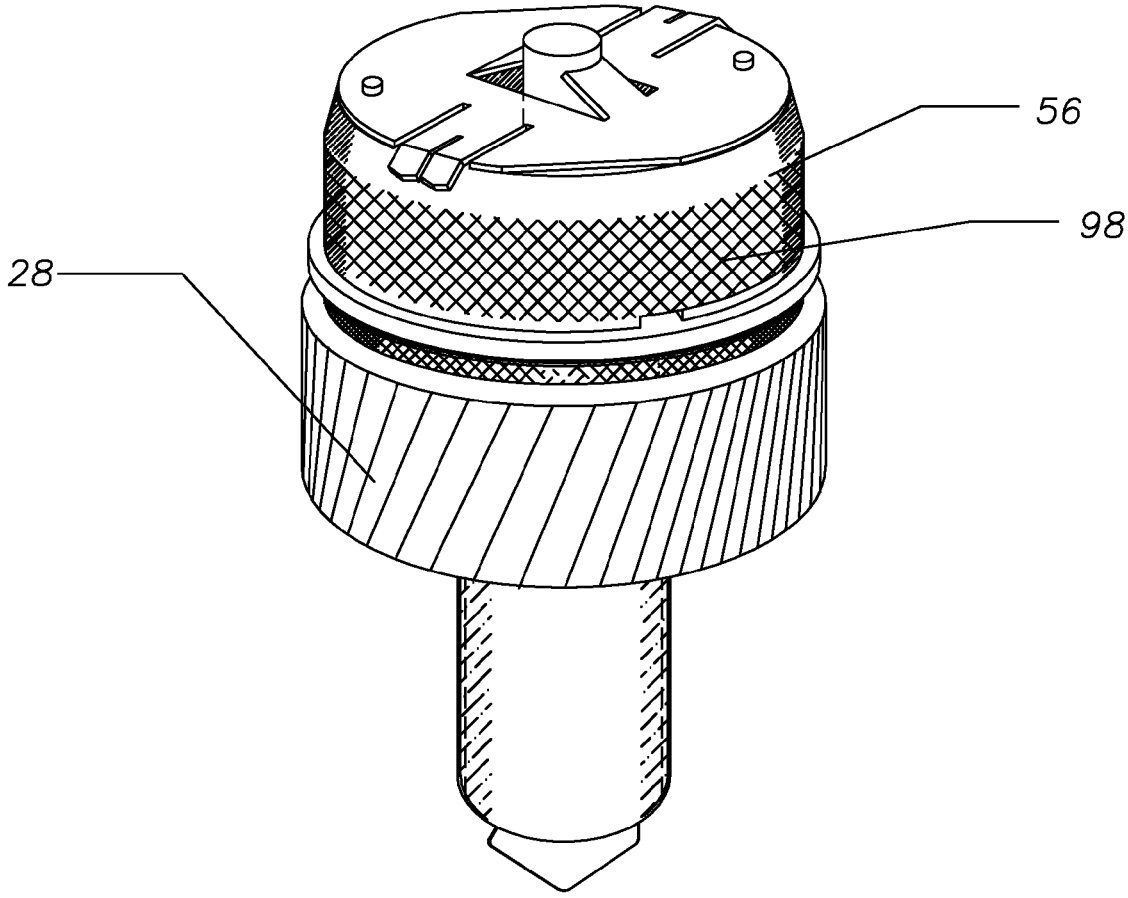
FIG. 5 is a perspective view of the original drum drive gear assembly after treating the adhesion surface with knurling in order to roughen the surface.

Referring to FIG. 5, a preferred surface treatment process will be described. A surface treatment is show as having been performed on the drive gear 28 by knurling the flange surface 56. The knurling is shown as a cross hatched surface 98, and this surface functions to promote the adhesion of the internal surface of the new drum cylinder 22 (FIG. 1) to the flange surface 56.

Figure 6:
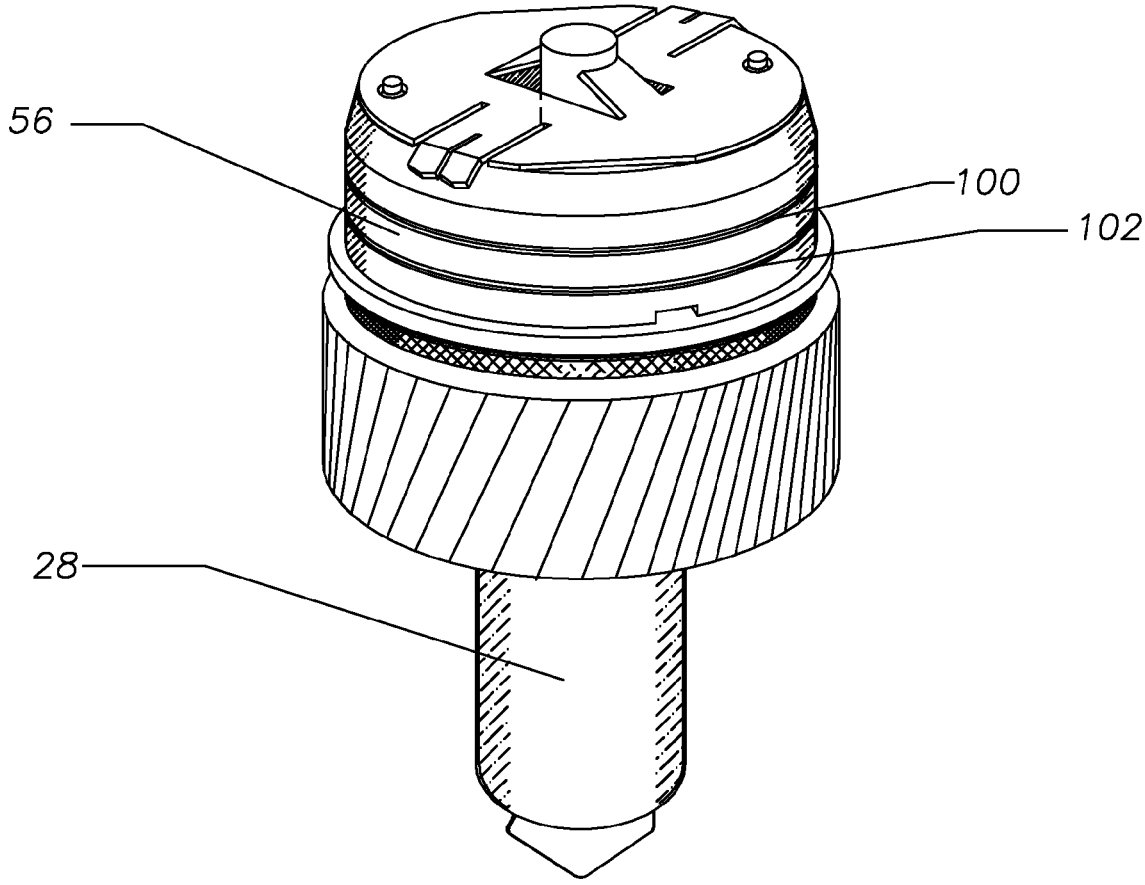
FIG. 6 is a perspective view of the original drum drive gear assembly after cutting grooves at the adhesion surface in order to create run-out channels for the adhesive after the assembly of the gear on the drum.

Referring to FIG. 6, another preferred surface treatment is described. In the process shown in FIG. 6 the drive gear in the location of the flange 56 was treated by cutting grooves 100, 102 in the plastic gear in order to create run-out channels. These run-out channels function to provide a path for the adhesive to flow as the gear 28 is pushed into the drum cylinder 22 (FIG. 1) and as described in further detail. The groves also function to enhance adhesion between the gear 28 and the drum cylinder 22 (FIG. 1).

Referring to FIG. 7 a preferred process of media blasting the surface of the drive gear 28 will be described. The media blasting surface treatment is conducted at the adhesion surface(s) shown at 54. The adhesion surface(s) 54 includes the two surfaces of the original drive gear that were utilized to adhere or attach the gear to the drum cylinder. Those two surfaces are flange surface 56 that function was designed in the prior art to assure parallelism and concentricity to the drum cylinder and the tapered surface 58 that functions was designed in the prior art to guide the gear into the drum cylinder during installation. In accordance with the principles of the present invention both surfaces are preferably were utilized to promote adhesion between the drive gear and the drum cylinder. Preferably no mechanical crimping is performed in the preferred embodiments of the present inventions.

As shown in FIG. 7 the gear is placed on an electrical rotation apparatus 103 that has a protection housing 104, an electrical motor 106 and a gear drive collar 108. The gear 28 is placed in the drive gear collar 108. A ground plate cover 110 is placed on the ground plate 34 in order to protect the metal from abrasion that would otherwise expose the plate 34 to severe corrosive attack. The assembly is then put in a conventional media spray booth (not shown) and the drive gear 28 is then rotated at a uniform speed. As the electrical rotation apparatus 103 turns, conventional blasting media is then blasted using a media blasting gun 112 and blasting media 114 in a preset angle Ø to the surface of the ground 34 and at a predetermined distance from the gear 28. The media blasting functions to roughen the flange surface 56 and the tapered surface 58. This process enhances adhesion between the drive gear 28 and the drum cylinder 22 as shown in FIG. 1.

Figure 8:
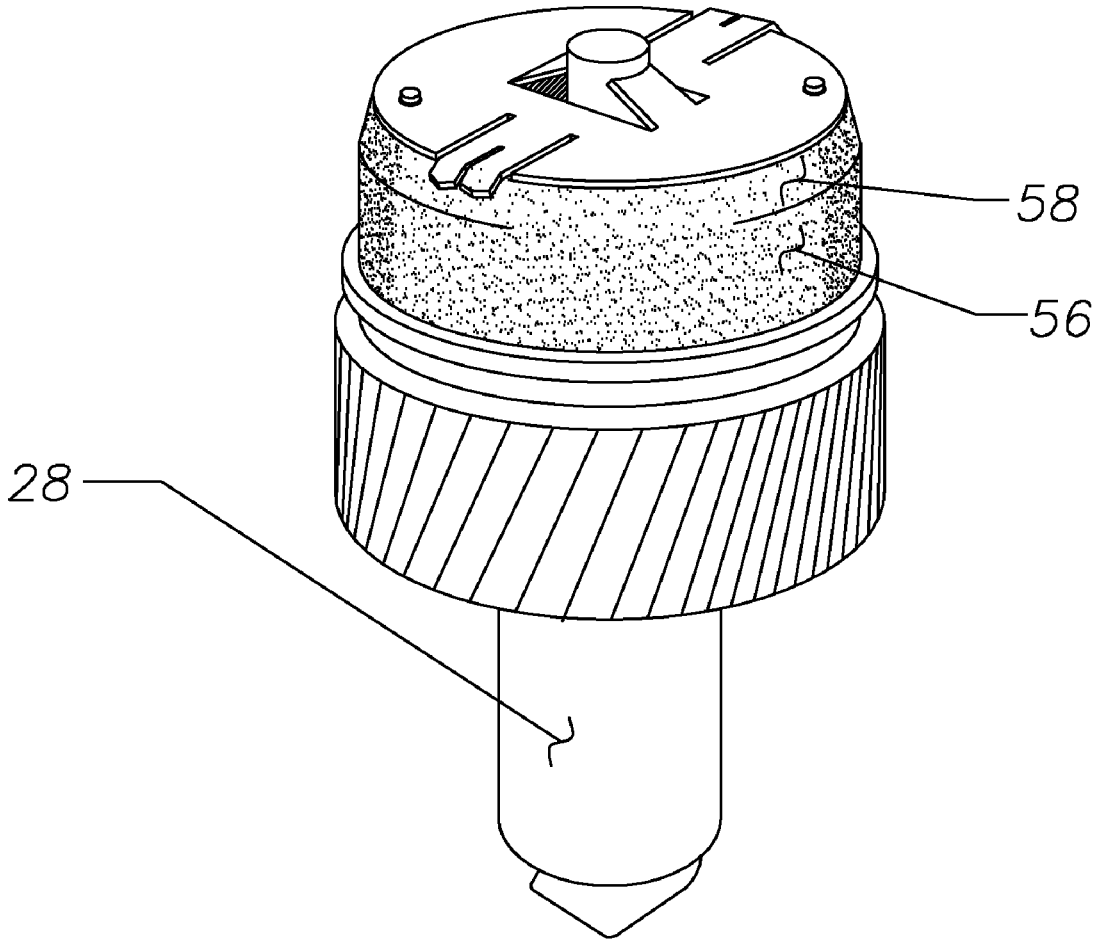
FIG. 8 is a perspective view of the adhesion surface of the drive gear after the sand blasting process.

Referring to FIG. 8 the drive gear 28 is shown after the adhesion surfaces 56 and 58 have been media blasted and roughened in comparison to the original smooth appearance as shown in FIG. 2.

Figure 9:
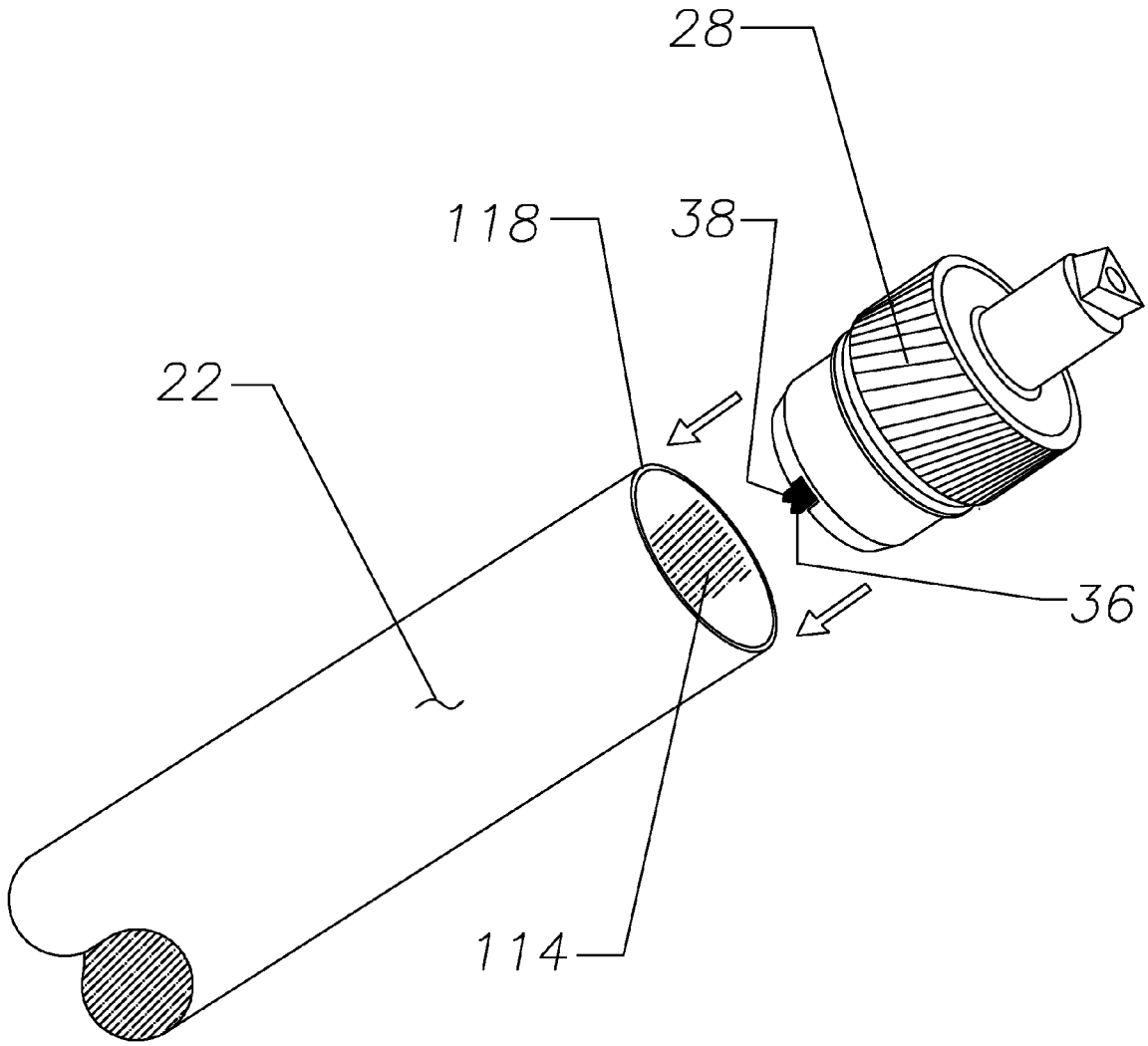
FIG. 9 is a perspective view of the orientation of the drive gear and the drum cylinder before installation.

Referring to FIG. 9 the orientation of the drive gear 28 to the drum cylinder 22 immediately before the gear is pushed into the drum is shown. The gear is positioned adjacent the end 118 of the drum 22. Also, as shown the tabs 36, 38 are positioned to be in-line with the laser patch 114 and this orientation is most preferable because it facilitates the subsequent adhesion process.

Figure 10:
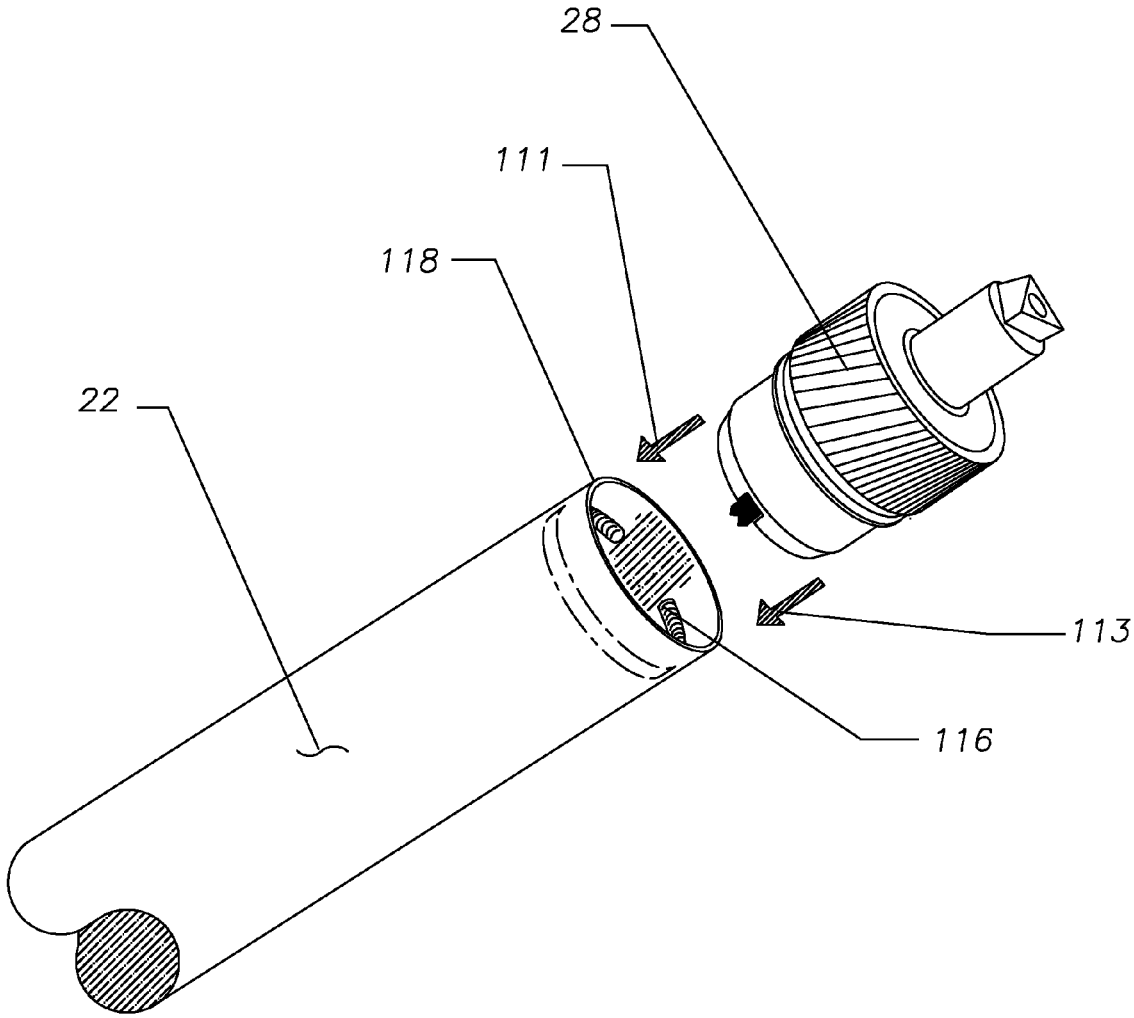
FIG. 10 is a perspective view of the orientation of the drive gear and the drum cylinder after applying the adhesive.

Referring to FIG. 10 the orientation of the drive gear 28 in relation to the drum cylinder 22 immediately after applying adhesive bead 116 is shown. The bead 116 is applied on the inside of the drum 22 as close as possible to the cylinder edge 118, and around that part of the inner periphery of the drum that has had its anodized surface removed by the laser treatment. In other words, the laser patch 116 is preferably kept free of adhesive. The gear is then pushed into the drum 22 in the direction of the arrows 111, 113.

Figure 11:
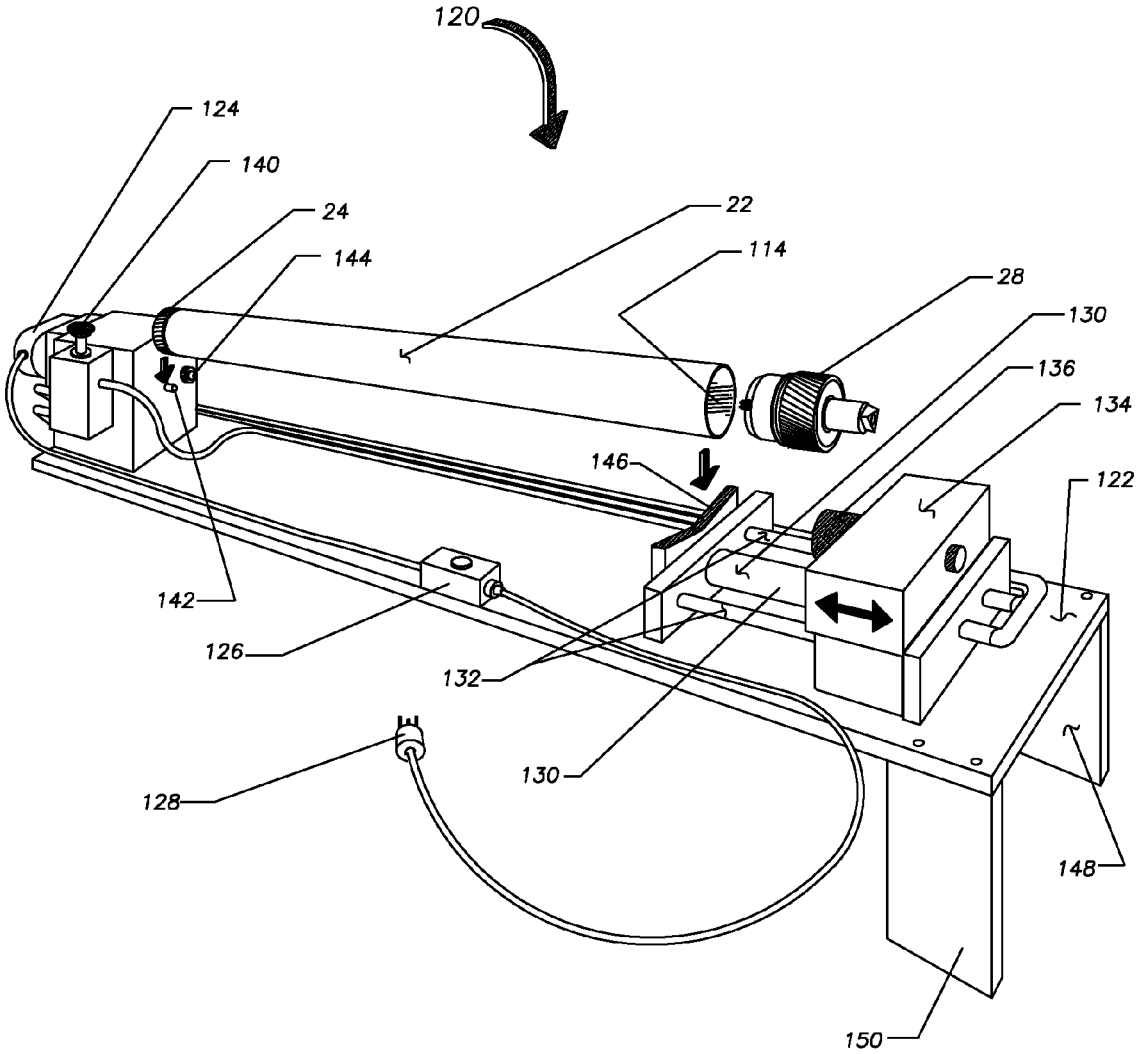
FIG. 11 is a perspective view of a preferred installation apparatus prior to application of adhesive; and, FIG. 12 is a perspective view of the FIG. 11 apparatus after application of adhesive to the inside of the drum cylinder.

Referring to FIG. 11 a gear installation apparatus 120 is shown prior to application of the adhesive on the inside of the drum 22. The installation apparatus 120 is comprised of a plate 122; a sliding gear cradle 134; a rotary gear insert 136; an air cylinder 130; slides 132, 132; a felt covered v-block 146; an alignment pin 142; a drive gear box and its external gear that engages with the axle gear 24, shown at 144; momentary pneumatic switch 140; an electric motor 124; and electric motor activating switch 126;, a power cord 128; and, angling legs 148, 150.

Figure 12:
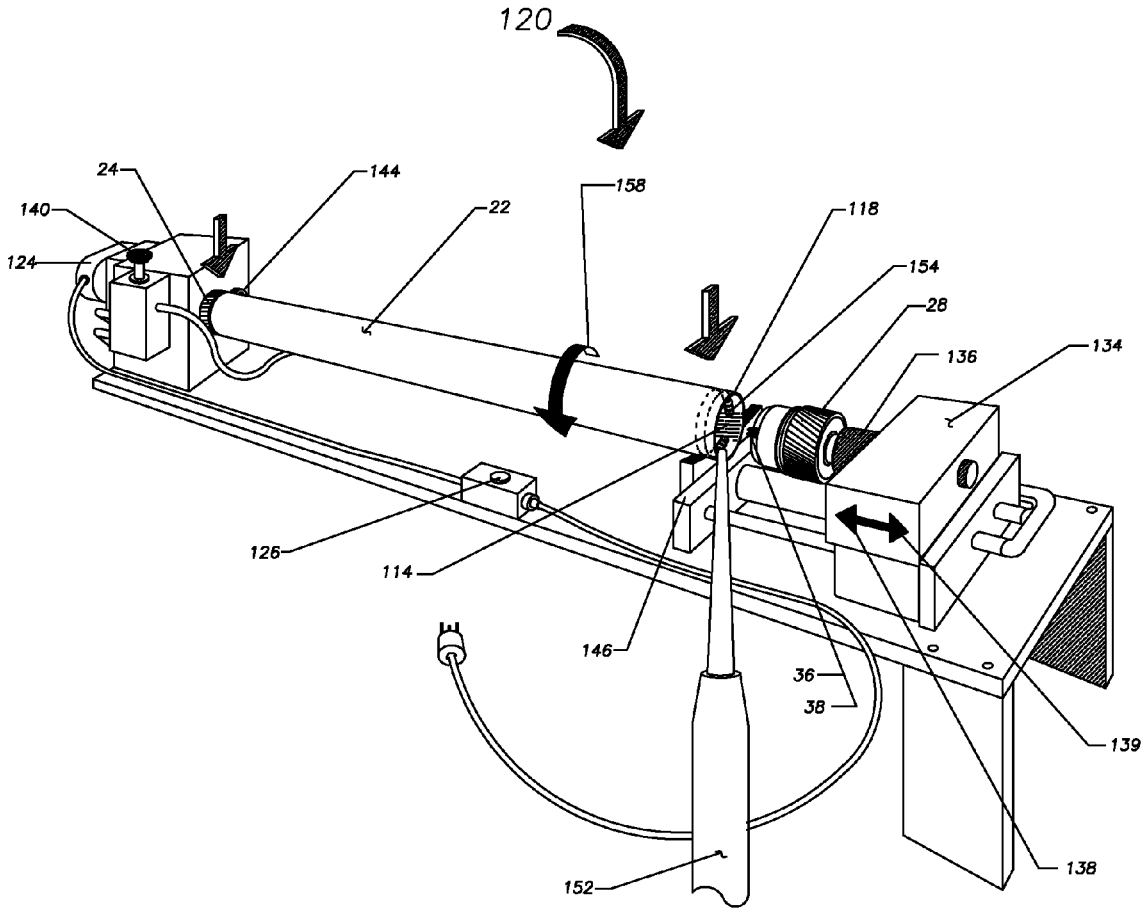

Referring to FIGS. 11-12 a preferred process of installing the drive gear 28 onto the drum cylinder 22 is described. Drum cylinder 22 is affixed into apparatus 120 by engaging or placing gear 24 over pin 142 and then lowering the drum 22 down to be in contact with and rest on the felt covered v-block 146. Next switch 126 is actuated and the drum then rotates a complete 360 degrees. During that rotation operation an adhesive bead 154 is applied to the inside of the drum 22. A dual component adhesive cartridge applicator 152 is used to apply the adhesive to the inside surface of drum 22, and the adhesive is applied, preferably, as close as possible to the edge of the cylinder 118 and around the entire inner periphery, but excluding the area of the drum that has the laser etch patch 114.

Preferably after being primed, and as described below, the drive gear 28 is then positioned onto the rotary insert 136. The gear 28 is then aligned with the drum 22 by manually rotating it so that tabs 36, 38 are aligned, preferably by visual inspection, with laser etched patch 114. Pneumatic switch 140 is then depressed to activate air cylinder 130, which then causes cradle 134 to move in the direction of arrow 138 and insert the gear into to drum at its end 118. Pneumatic momentary switch 140 is then released, causing air cylinder 130 to move cradle 134 in the direction of the arrow 139, that is, to return the cradle 134 back to its home position. An electrical continuity test is then conducted, preferably by contact ground member 48A, shown in FIG. 2, and an uncoated area in the drum cylinder 22 as the contact points.

In accordance with embodiments of the present invention the process of removing the original drive gear from a used photosensitive member and installing the used, original drive gear on a new photosensitive member will be described. Removing the prior art gear from the prior art drum cylinder is preferably accomplished by using a pneumatic clamp that holds the drive gear with the assistance of a pneumatic clamp apparatus 70, as shown in FIG. 3, and the gear is removed by twisting the drum's cylinder out of the gear and then releasing the gear by moving it back and forth, shown for example in FIG. 4 by the arrows 98, 100. This operation can be done by other means of clamping, such as for example hydraulic, electrical or manual means, any and all of which are considered to be equivalent, so long as the gear and the drum are separated without damage to the gear. The drum can be twisted out manually or pulled out using a hydraulic, pneumatic or mechanical means. In the conventional, prior art, original equipment, the drive gear is connected to the original drum cylinder by mechanical means such as crimping that uses two tabs of the pre-cut aluminum cylinder 94, as shown in FIG. 4. The tabs are pushed into two slots in the gear assembly, shown at 62 in FIG. 4. In accordance with the principles of the current invention, however, it is preferable that no mechanical clamping is performed. Rather and instead adhesion is used to connect and attach the drive gear to the drum cylinder.

In order to make sure that the presently described embodiments function to attach an original gear to a new drum as well as the original gear was attached to the original drum a series of torque measurements were taken. Those measurements were taken with a JETCO brand torque wrench, 0-100 ft. lb range. In regard to the prior art design, i.e., the original gear as attached to the original drum, the gear failed at 5 ft. lb. In other words at an application of 5 ft. lbs. of torque the gear would break loose from the drum. This value is referred to as the torque failure value, and was used as a benchmark or standard for determining the attachment or adhesion strength of various embodiments as described herein. In other words, in order for a process of attachment of an original gear to a new drum to be considered useful, it must meet or exceed the torque failure value of the original equipment drum and gear assembly.

Surface Treatment or Preparation of the Gear

As described herein four surface preparation methods are preferred: (a) knurling; (b) grooving; (c) media blasting; and (d) primer. The four different techniques were experimented with in order to generate a larger and/or better surface for adhesion, and thus increase the strength of the adhesion, gripping power or mechanical grip of the adhesive to the surface of the gear. It is believed that in the prior art designs only mechanical crimping was employed to attach the gear to the drum, with no adhesive used, and that no consideration was given to the adhesion affinity of the surfaces of the gear and the drum cylinder with respect to each other. The prior art gears intended to be used in the present inventions were made of nylon polymer. As is well known, it is extremely hard to make another structure or item adhere to a component made of nylon polymer, due to the very nature of the nylon polymer.

In order to enable adhesion, it was discovered that surface treatment was needed, and the knurling, grooving and/or media blasting techniques proved to be useful. Furthermore, it has been discovered that the use of all four methods or techniques produces superior adhesion properties after 24 hours from the time of application of the adhesive. It has also been discovered that if used alone, the knurling and grooving processes do not produce such superior results. Rather, for gear-drum assemblies made with only a knurling or grooving surface treatment, a consistent decline in adhesion strength over time, in aggressive environments, such as high humidity and extreme temperature differences, has been found to result.

It has also been discovered that the most preferable or most desirable surface treatment is media blasting using Aluminum-Oxide grit #220 as a blasting media. It is believed that other types of media and grit can be used to achieve a useful result. The blasting pressure was 40-70 psi and the gears were blasted using a media blasting gun commercially available from CYCLONE. As seen in FIG. 7 the grounding plate 34 had to be used during the media blasting process, in order to prevent the media from damaging the protective coating on the surface of the phosphorus bronze plate. Failure to protect the coating with the grounding plate would result in severe corrosion that will be developed in a matter of hours. Such corrosion can lead to electrical discontinuity between the ground member 48, shown in FIG. 2, and the drum-cylinder 22, as shown in FIG. 1, and could also lead to possible failure of the photosensitive member, and thus failure of the cartridge. The media blasting process was done using an electrical motor assembly or apparatus as shown in FIG. 7. The gear was rotated 2-4 complete rounds at a slow speed of 8-12 revolutions per minute, as the blasting gun was held at a distance of about 1-3 inches from the surface, and at a 25-75 degree angle Ø from the surface of the flange 56, also as shown in FIG. 7. The prior art gear was media blasted in a conventional blasting chamber made by UNIVERSAL EQUIPMENT MANUFACTURING CO. The media was reused in a conventional fashion. Other blasting systems or chambers can be used, for example gravity fed blasting guns or other techniques, so long as they provide for the end result of a gear surface preparation sufficient to yield adhesion of the gear to the drum at above the torque failure value.

Cleaning of the Surface Treated Gear

Preferably the surface treated gear is then cleaned in order to remove all grease and contamination residues as well as media blasting residues. Cleaning preferably was achieved by using air blasting to remove the bigger particles and then by submerging the surface treated drive gears in a conventional ultrasonic bath. Preferably iso-propanol is used in the bath as a degreaser, and the ultrasonic bath is lasts for at least 1 minute. Preferably the cleaned gears are then dried in ambient air for at least 5 minutes. Other techniques can be used to clean the drive gears such as manual brushing, wiping, flushing or dipping numerous times, so long as the end result is a surface treated gear that will adhere to the drum at greater than the torque failure value.

Straightening Contact Tabs

The contact tabs of the original gear are also straightened, preferably after the gear has been surface treated and cleaned. In the preferred embodiments described above, straightening of the contact tabs 36, 38, 40 and 42 was done using pointed pliers. The tabs on the ground plate 34, shown in FIG. 2, come bent and once taken out of the original gear tend to deform. Unless straightened, the typical deformation of the original gears might cause electrical discontinuity. Therefore, the tabs are preferably straightened in order to facilitate electrical continuity between the tabs and the internal surface of the drum cylinder when the original drive gear is installed on a new drum, as describe herein.

Oxidation Removal From the New Drum

As is well known the typical, original photosensitive drum is manufactured with a technique that does not involve anodizing of the aluminum cylinder. As described above, however, the preferred embodiments of the current inventions relate to a new drum cylinder that is manufactured using an anodizing process in order to adhere the photo sensitive coating to the aluminum cylinder surface. The anodizing process is one in which the electrical conductivity property of the anodized metal is greatly reduced. Thus, in order to provide for electrical continuity in a drum-gear assembly having an anodized drum, it is preferred that part of the anodized area of the drum is removed and a conductive path be established. In the event a new drum to be used with an original gear and in accordance with the principles of the present inventions is not anodized, then this part of the process can be skipped.

Preferably a laser etching technique is used to etch a rectangular patch close to the end 118 of the cylinder, as shown at patch 114 in FIG. 9. This patch is made in order to provide a conductive path for electrical continuity between the ground plate 34 on the drive gear 28, as shown in FIG. 2, and the drum. The laser etching removes the insulating, anodizing layer on the inner surface of the aluminum cylinder and exposes the conductive aluminum. An equivalent result can be achieved with other processes, such as with mechanical means, sand paper, etc. The laser etch process is preferred due to its relatively high speed and cleanliness. Moreover, any mechanical removal process might cause dust residues that can contaminate the surface of the photosensitive coating and would require additional labor to clean.

Adhesive Application

As described above the original gear, preferably processed as describe above, is adhesively attached to a new drum. In this regard three main groups of adhesives were tested for their adhesion properties in this application. Those three groups were: cyano-acrylates; acrylics; and, epoxies. Samples of these adhesives were applied on the internal surface of a drum cylinder. Because the gear is very close in dimensions to the inner orifice of the cylinder, i.e., a very tight fit, whenever adhesive is applied to the gear's surface, the adhesive will come out when the gear is pushed into the drum. This external adhesive then has the potential to might cause contamination of the outer surface of the drum. In order to avoid or minimize this risk, it is preferable that adhesive be applied on the inner surface of the cylinder. Thus, once the drive gear is installed the adhesive residues are pushed inside the cylinder.

Shown below in Tables 1-3 are results of adhesive testing with a variety of adhesives, surface preparations and test conditions. Adhesive application was tested first without surface treatment to the gear. The first adhesive candidates were in the cyano-acrylate family, because of the ease of use and the low cost. As can be seen in Table 1, two brands of cyano-acrylates were used. The first was Permabond 910 available from Permabond Engineering Adhesives. This is a 100% methyl cyano-acrylate, single part, low viscosity, fast cure cyano-acrylate. The second was Loctite 411 brand adhesive made by Henkel Loctite Corporation. This is also a low viscosity, fast cure cyanoacrylate, specifically, a single part, ethyl cyanoacrylate.

In comparing the adhesion strength, as can be seen from samples 1-6 on Table 1, where no surface treatment was used, the Loctite 411 brand adhesive yields higher adhesion strength with an average failure torque value for the Permabond 910 brand adhesive of 16 and an average failure value of 19.3 for the Loctite 411 brand adhesive. Moreover, the Loctite 411 adhesive is lower in viscosity and easier to apply than the Permabond 910 adhesive.

Referring to sample or test number 7, when the gear was surface treated with sand blasting and the ethyl cyano-acrylate adhesive was used, the torque failure value was 40, which represents a significant increase in adhesion strength. Referring to samples 8-9, a two-part epoxy adhesive was used. Specifically, Scotch-Weld DP190 brand epoxy/amine adhesive, available from 3M Company was used. The DP190 brand epoxy adhesive had an average failure torque of 14, when no surface treatment was used. When a "primer only" surface treatment was used, the DP190 brand adhesive yielded failure torques of 20, referring to samples 10-11. When the gear was surface treated with sand blasting the DP190 adhesive yielded a failure torque of 15, as shown in sample 12, which compared unfavorably to a relatively high value of 40 for sample 7, in which Loctite 411 adhesive was used with a gear that had been surface treated with sand blasting. Referring to samples 12-13, the DP190 had relatively low failure values when surface treated with sand blasting and sand blasting plus primer, respectively. Referring to sample 14 a two-part acrylic adhesive was used. Specifically, 3M Scotch-Weld, DP-810 brand acrylic adhesive was used. As shown in sample 14, the DP-810 brand adhesive had a very low failure torque of 5, when tested without surface treatment, much lower than either the Permabond 910 or Loctite 411 adhesives when used without surface treatment.

The Table 1 torque tests also showed that in most cases the rupture surface was the plastic of the gear itself, rather than at the adhesion. This means that the gear broke before the adhesion surface was disconnected. As shown in Table 1, in all tests in which a cyano-acrylate adhesive was used, it was the gear itself that failed; not the adhesion. When the epoxy or acrylic adhesives were used, however, in only one instance did the failure result in the gear. All other failures (samples 8-12 and 14) were in the adhesion itself. The results of the tests as shown in Table 1 suggested that the cyano-acrylate adhesives were good candidates, with the Loctite 411 brand adhesive holding the most promise.

Referring to Table 2, new test samples 15-17 were prepared then tested using Loctite 411 adhesive in a thermal cycling chamber. Specifically, a TEST EQUITY 1000 SERIES brand temperature chamber was used, with the samples tested for 10 days with the following temperature cycle that repeated itself during the whole 10 days: (a) 20 minutes ramp up from 25-55 degrees C.; (b) 90 minutes at constant 55 degrees C.; (c) 30 minute ramp down from 55 degrees C. to 10 degrees C.; (d) 90 minutes at −10 degrees C.; (e) 20 minute ramp up −10 degrees C. to 25 degrees C. As can be seen from the results on samples 15-17, the adhesion strength essentially completely failed after the temperature cycle testing. It was observed by visual inspection that in every one of samples 15-17 the adhesive residues were held to the aluminum and none were held to the gear. As a result, it was believed that cyano-acrylates are too brittle for this application. Aluminum and the nylon have much different thermal expansion coefficients, and thus the shear forces on the adhesion surface are believed to be too strong to maintain a bond after temperature cycling of the type exemplified above. In order to overcome this problem, it was believed that surface treatment applied to the gear might reduce or eliminate this problem.

Four types of surface treatment were chosen to be tested: knurling, grooving, sand blasting and primer. All four surface treatments were thermal cycle tested against each other in the thermal cycling chamber. As can be seen from tests 18-20 in Table 2, the failure values for knurling, grooving and sand blasting after the thermal cycling were still significantly lower in comparison to the corresponding values obtained the day after the application of the adhesive, as shown on Table 1, samples 4-6. These results prompted use of primer and sand blasting. Specifically, Loctite 770 brand plastic primer was applied on the gear prior to applying the adhesive. Loctite 770 brand plastic primer is a cyano-acrylate, specifically, an aliphatic amine in a n-Heptane solution. The results are shown samples 21-23 on Table 2. The deterioration of the adhesion strength after the thermal cycle test was also shown to be significant, with the rupture taking place at relatively low values and at the adhesion.

Next, a flexible adhesive system was chosen in an attempt to compensate for the difference in thermal expansion coefficients between the nylon and the aluminum of the gear and drum, respectively. The epoxy adhesive that was tested was the flexible, dual component system DP190 from 3M and as an acrylic system the dual component DP-810 adhesive system from 3M was tested. As can be seen from sample 14 in Table 1, use of the DP-810 adhesive resulted in very low adhesion strength compared to the cyano-acrylates and epoxies. However, the DP190 flexible epoxy system resulted in much better performance than the acrylic system but still exhibited significantly lower failure values than did the cyano-acrylates system in failure testing conducted at time "Zero", i.e., one day after the adhesive was applied, and as reported in Table 1.

Also, in order to promote the adhesion a different primer was added to the system as a surface treatment. The primer was DP190 adhesive diluted in iso-propanol at a 1:10 ratio. This high dilution ratio yielded a very low viscosity fluid and enabled application of the primer to the adhesion surface of the gear without concern that it would come out and contaminate the drum once the gear was inserted into the drum cylinder. As can be seen from samples 10-11 in comparison to samples 8-9 in Table 1, the presence of the DP190 primer promoted the adhesion significantly in comparison to the tests with the same adhesive but without a surface treatment. The DP190 adhesive and the DP190 adhesive-primer surface treatment system was then used and tested in the thermal cycles testing and using the same chamber and test procedure as referred to above. The results are reported in samples 24-27 in Table 2. Application of primer on the surface of the gear was shown to promote adhesion, but significant deterioration in adhesion strength remained after thermal cycling with and without primer.

A combination of media blasting and primer as a surface treatment was used and tested, with the results reported as sample 13 in Table 1. In this sample the gear plastic failed rather than the adhesion surface, and the bond strength was significantly higher than the samples that used DP190 adhesive and only one of the two surface treatments. The gear-drum assembly having the combination of primer and sand blasting as a surface treatment was then tested in the thermal cycling chamber under the test procedure referred to above. The results are reported in samples 29-34 on Table 2. It can be seen that not only did the bond strength not deteriorate over the time of the test period, but became stronger. As a result, the combination of both sand blasting and priming of the gear's surface was chosen as the most preferred surface treatment and this surface treatment in combination with the DP190 adhesive was chosen as the most preferred technique or method for adhesively attaching a gear to the drum.

In order to further evaluate bond strength in aggressive, corrosive conditions over time, sample gear-drum assemblies were tested in a walk-in temperature humidity chamber made by WATLOW SERIES F4S/D. This testing was conducted at 80% rH and 80 degrees F. for 14 days. The results are reported as samples 35-40 in Table 3. As shown in Table 3, bond strength greatly varies in these samples, but is still significantly higher than 5 ft. lb. standard that was determined by measuring the failure torque for the mechanical coupling of the original gear-drum assembly. From Table 3 it can be seen that the interface of rupture is affected by humidity as well as by thermal cycling and that most of the failures took place at the adhesion (samples 35-40, 43) rather than in the gear plastic (samples 41-42). Also, it may be seen from samples 41-43, the bond strength is very high and the interface of rupture is within the plastic (samples 41-41) or within the adhesion (sample 43), even when using only primer. As a result of the testing reported in Table 3, it is believed that the presence of humidity is not the main cause or even a significant cause of deterioration in bond strength. Even if humidity is significant in some instances, it appears that the flexible epoxy system is superior in adhesion strength to the cyano-acrylates system when performance over time is considered. Referring to sample 28, this sample shows that sand blasting alone as a surface treatment is not enough to yield a successful adhesion over time and that use of the DP190 adhesive was needed to yield successful adhesion over time.

As understood from the above reported results, cyano-acrylates have relatively low torque failure values in temperature cycling tests and the flexible epoxy adhesive, DP190 brand adhesive, performs the best. Even though cyano-acrylate adhesives perform very well, at start, that is soon after curing, torque failure value decreases significantly after thermal cycling. As a result of thermal cycle testing the most preferred process for attaching the gear to the drum includes surface treating the gear that includes a primer prior to applying adhesive. The preferred primer is DP190 adhesive-primer, available from 3M, and this is used when diluted in iso-propanol at a ratio of 1:10. The primer is preferably applied using a swab on the bond area and dried in ambient air for no less than 5 minutes. The dilution 1:10 was derived from the need to keep the primer thickness as thin as possible to prevent run-out of material as the gear is pushed inside the drum cylinder, but nevertheless to provide a useful surface treatment.

Application of the adhesives as reported in Tables 1-3 was conducted with the gear assembly apparatus or machine as illustrated in FIGS. 11-12. Also, the two-component adhesives were applied using a dual component adhesive gun dispenser as referred to above. The cyanoacrylate, mono-component adhesives were dispensed directly from the tubes in which they were packaged. The dual cartridge was connected to a static mixer. Both the dispensing gun and the static mixer were made by and available from 3M Company. They are standard for dual component cartridge applications. The test samples were also tested for electrical continuity between the drum cylinder and the drive gear ground member using continuity testeribuzzer available from ILM TOOL INC. In this testing the contact on the drum side is pushed with sufficient force pass through the insulating anodizing layer and to touch the conductive aluminum. The gear-drum assemblies were cured by stacking the drums vertically with the drive gear facing down in order to allow the adhesive to flow during the curing time into the space created between the tapered surface on the drive gear, shown at 58 in FIG. 2, and the drum cylinder. This was to increase the area of the adhered surface, and thus increase the adhesion strength of the gear to the drum. The drums were cured for not less than 24 hours prior to assembly into a cartridge.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

TABLE 1

Room temperature (reference) testing (75 degrees F. and 30% rH)

| Test Number | Adhesive | Adhesive Group | Drive gear Surface Treatment | Test type | Torque (Ft-Pound) | Interface of Rupture* |
|---|---|---|---|---|---|---|
| 1 | Permabond 910 | Cyano-Acrylate | None | Torque | 18 | Plastic |

TABLE 1-continued

Room temperature (reference) testing (75 degrees F. and 30% rH)

| Test Number | Adhesive | Adhesive Group | Drive gear Surface Treatment | Test type | Torque (Ft-Pound) | Interface of Rupture* |
|---|---|---|---|---|---|---|
| 2 | Permabond 910 | Cyano-Acrylate | None | Torque | 20 | Plastic |
| 3 | Permabond 910 | Cyano-Acrylate | None | Torque | 10 | Plastic |
| 4 | Loctite 411 | Cyano-Acrylate | None | Torque | 18 | Plastic |
| 5 | Loctite 411 | Cyano-Acrylate | None | Torque | 30 | Plastic |
| 6 | Loctite 411 | Cyano-Acrylate | None | Torque | 10 | Plastic |
| 7 | Loctite 411 | Cyano-Acrylate | Sand Blasting | Torque | 40 | Plastic |
| 8 | DP190 | Epoxy | None | Torque | 15 | Adhesion |
| 9 | DP190 | Epoxy | None | Torque | 13 | Adhesion |
| 10 | DP190 | Epoxy | Primer only | Torque | 20 | Adhesion |
| 11 | DP190 | Epoxy | Primer only | Torque | 20 | Adhesion |
| 12 | DP190 | Epoxy | Sand Blasting | Torque | 15 | Adhesion |
| 13 | DP190 | Epoxy | Sand Blasting + Primer | Torque | 30 | Plastic |
| 14 | DP-810 | Acrylic | None | Torque | 5 | Adhesion |

*Interface of Rupture: The term "Plastic" means that the plastic of the drive gear broke before the adhesive failed. The term "Adhesion" means the adhesive separated from the gear and/or the drum before either of the substrates failed.

TABLE 2

Test results after Temperature cycles for 10 days

| Test Number | Adhesive | Surface Treatment | Test type | Torque (Ft-Pound) | Interface of Rupture |
|---|---|---|---|---|---|
| 15 | Loctite 411 | None | Torque | 0 | Adhesion |
| 16 | Loctite 411 | None | Torque | 2 | Adhesion |
| 17 | Loctite 411 | None | Torque | 1 | Adhesion |
| 18 | Loctite 411 | Knurling | Torque | 5 | Adhesion |
| 19 | Loctite 411 | Grooving | Torque | 7 | Adhesion |
| 20 | Loctite | Sand Blasting | Torque | 3 | Adhesion |
| 21 | Loctite 411 | Sand + 770 Primer | Torque | 0 | Adhesion |
| 22 | Loctite 411 | Sand + 770 Primer | Torque | 17 | Adhesion |
| 23 | Loctite 411 | Sand + 770 Primer | Torque | 10 | Adhesion |
| 24 | DP190 | None | Torque | 7 | Adhesion |
| 25 | DP190 | Primer | Torque | 10 | Adhesion |
| 26 | DP190 | Primer | Torque | 9 | Adhesion |
| 27 | DP190 | Primer | Torque | 12 | Adhesion |
| 28 | DP190 | Sand Blasting | Torque | 10 | Adhesion |
| 29 | DP190 | Sand Blasting + Primer | Torque | 55 | Plastic |
| 30 | DP190 | Sand Blasting + Primer | Torque | 45 | Plastic |
| 31 | DP190 | Sand Blasting + Primer | Torque | 65 | Plastic |
| 32 | DP190 | Sand Blasting + Primer | Torque | 60 | Adhesion |
| 33 | DP190 | Sand Blasting + Primer | Torque | 60 | Plastic |
| 34 | DP190 | Sand Blasting + Primer | Torque | 50 | Adhesion |

TABLE 3

Torque testing after Temperature Humidity testing for 10 days

| Test Number | Adhesive | Surface Treatment | Test type | Torque (Ft-Pound) | Interface of Rupture |
|---|---|---|---|---|---|
| 35 | Permabond 910 | None | Torque | 14 | Adhesion |
| 36 | Permabond 910 | None | Torque | 14 | Adhesion |
| 37 | Permabond 910 | None | Torque | 15 | Adhesion |
| 38 | Loctite 411 | None | Torque | 30 | Adhesion |
| 39 | Loctite 411 | None | Torque | 22 | Adhesion |
| 40 | Loctite 411 | None | Torque | 12 | Adhesion |
| 41 | DP190 | Primer | Torque | 35 | Plastic |
| 42 | DP190 | Primer | Torque | 40 | Plastic |
| 43 | DP190 | Primer | Torque | 35 | Adhesion |

What is claimed is:

1. A method for installing an original drive gear of an original photosensitive drum for a laser printer toner cartridge on a new photosensitive drum for a laser printer toner cartridge comprising:

providing an original assembly that includes the original photosensitive drum and the original drive gear;

providing a new photosensitive drum, the new photosensitive drum being in the form of a cylinder having a new drum inner periphery and a new drum first end;

the original photosensitive drum being in the form of a cylinder having an inner periphery and an original drum first end;

the original drive gear having a contact surface that is in mechanical contact with the original photosensitive drum inner periphery, the contact surface is attached to the inner periphery at the original photosensitive drum first end and the contact surface has a predetermined adhesive capability;

removing the original drive gear from the original photosensitive drum and exposing the original drive gear contact surface;

treating the original drive gear contact surface to increase its adhesive capability and to form a surface treated original drive gear;

placing an epoxy/amine adhesive on a portion of the new drum inner periphery at the new drum first end;

inserting the surface treated original drive gear into the new drum first end; and, curing the adhesive.

2. The method of claim 1, wherein said new photosensitive drum is made of aluminum.

3. The method of claim 1, wherein said new photosensitive drum is made of aluminum and has an anodized surface.

4. The method of claim 3 further includes removing a portion of the anodized surface of the new photosensitive drum to form an electrically conductive surface.

5. The method of claim 4 wherein the portion of new drum inner periphery on which the adhesive is applied substantially excludes the electrically conductive surface.

6. The method of claim 1, wherein treating the original drive gear contact surface includes knurling the contact surface.

7. The method of claim 1, wherein treating the original drive gear contact surface includes grooving the contact surface.

8. The method of claim 1, wherein treating the original drive gear contact surface includes blasting with an abrasive media.

9. The method of claim 1, further including applying a primer on the contact surface prior to placing the adhesive on the contact surface.

10. The method of claim 1, wherein treating the original gear contact surface includes blasting the contact surface with an abrasive media and thereafter applying a primer on the contact surface.

11. The method of claim 10, wherein the primer includes a flexible dual component epoxy.

12. The method of claim 1, wherein the adhesive is a flexible dual component epoxy.

13. A laser printer toner cartridge photosensitive drum and drive gear assembly comprising:

a new photosensitive drum being in the form of a cylinder, having a new drum inner periphery and having a new drum first end;

an original drive gear having a contact surface;

an organic adhesive positioned between the original drive gear contact surface and the new photosensitive drum inner periphery, whereby the original drive gear is adhered to the new drum inner periphery with the organic adhesive at the new drum first end and is adhered to the new drum with an adhesive strength having a torque failure value of at least 5 ft. lbs.

14. The assembly of claim 13 wherein the organic adhesive is an epoxy/amine adhesive.

15. The assembly of claim 13 wherein the organic adhesive is a flexible dual component epoxy.

16. The assembly of claim 13 wherein the original drive gear contact surface was sand blasted.

17. The assembly of claim 13 wherein the original gear contact surface has been coated with a primer comprising an epoxy/amine.

18. The assembly of claim 13 wherein the original gear contact surface has been sand blasted and coated with a primer comprising an epoxy/amine.

19. A method for installing an original drive gear of an original photosensitive drum for a laser printer toner cartridge on a new photosensitive drum for a laser printer toner cartridge comprising:

providing an original assembly that includes the original photosensitive drum and the original drive gear;

providing a new photosensitive drum made of aluminum, having an anodized aluminum layer on its surface, being in the form of a cylinder having a new drum inner periphery and having a new drum first end;

the original photosensitive drum being in the form of a cylinder having an inner periphery and an original drum first end;

the original drive gear having a contact surface that is in mechanical contact with the original photosensitive drum inner periphery, the contact surface is attached to the original drum inner periphery at the original photosensitive drum first end and the contact surface has a predetermined adhesive capability;

removing the original drive gear from the original photosensitive drum and exposing the original drive gear contact surface;

treating the original drive gear contact surface by sand blasting and thereafter coating the contact surface with a solution of a flexible dual component epoxy and isopropanol in the ratio of about 1:10 to form a surface treated original drive gear;

removing a portion of the anodized surface from the inner periphery of the new photosensitive drum near the new photosensitive drum first end to form an anodized-free patch area;

placing a predetermined amount of DP190 brand epoxy/amine adhesive on a portion of the new drum inner periphery at the new drum first end having an anodized layer and maintaining free of the DP190 brand epoxy/amine adhesive a substantial portion of the anodized-free patch area;

inserting the surface treated original drive gear into the new drum first end; and, curing the adhesive for at least 12 hours at a temperature in the range of about 60-75 degrees F.

* * * * *